United States Patent [19]

Harken et al.

[11] Patent Number: 4,718,371

[45] Date of Patent: Jan. 12, 1988

[54] RESILIENT SUPPORT FOR YACHT FITTING

[75] Inventors: Peter O. Harken, Pewaukee; Eugene J. Cramer, Milwaukee, both of Wis.; Robert A. Whitehouse, Newport, R.I.

[73] Assignee: Vanguard, Inc., Pewaukee, Wis.

[21] Appl. No.: 885,289

[22] Filed: Jul. 14, 1986

[51] Int. Cl.[4] ..... B63B 21/10

[52] U.S. Cl. ..... 114/364; 114/218; 254/415; 254/413; 267/153

[58] Field of Search ..... 114/364, 343, 102, 213, 114/216, 218, 205; 254/413, 414, 415; 267/153

[56] References Cited

U.S. PATENT DOCUMENTS

| | | | |
|---|---|---|---|
| 168,498 | 10/1875 | Hunt | 254/415 |
| 655,851 | 8/1900 | Coleman | 254/415 |
| 3,305,227 | 2/1967 | Henley | 267/153 |
| 3,388,891 | 6/1968 | De Meo | 254/415 |
| 3,678,876 | 7/1972 | Alter | 114/102 |
| 4,077,275 | 3/1978 | Kluge et al. | 267/153 |
| 4,160,541 | 7/1979 | Harken et al. | 114/218 X |

*Primary Examiner*—Joseph F. Peters, Jr.
*Assistant Examiner*—Paul E. Salmon
*Attorney, Agent, or Firm*—Juettner Pyle Lloyd & Verbeck

[57] ABSTRACT

A resilient support is provided for maintaining a pivotally mounted yacht fitting in an upright position. The support is in the form of a conical section made from a resilient polymeric material.

7 Claims, 3 Drawing Figures

RESILIENT SUPPORT FOR YACHT FITTING

BACKGROUND OF THE INVENTION

This invention relates to improvements in yacht fittings such as pulleys or bearing blocks, and more particularly to a resilient support for an upright bearing block to be mounted on the deck or other structure of a sailboat.

Upstanding pulleys or bearing blocks on sailing craft are used to carry and control various lines, such as jib sheets, halyards, and other control lines. For example, the base or post of the block is attached by suitable fittings to the deck such that the block may move from side to side or turn around a vertical axis, thereby to receive a line from various angles.

In accordance with prior art practices, it has been known to dispose a helical spring around the post of the block between the base of the block and the deck fitting. The spring is lightly compressed upon installation and tends to hold the block in an upright position, or at right angles relative to the attachment surface. Examples of such springs may be found in the 1986 catalogue of Harken Yacht Fittings located in Pewaukee, Wis. The use of these springs makes it easier to rig the boat, and they also prevent the block from flopping over to one side and causing damage to the support surface or the block.

The use of a resilient spring, however, is not entirely suitable for all purposes. The spring may tend to catch the line, causing jamming problems. Moreover, heavier and large blocks would require the use of a very heavy or large spring, which is impractical. As a consequence, some fittings, such as snatch blocks, have been provided with padded surfaces to prevent injury to the surrounding areas under sailing conditions.

SUMMARY OF THE INVENTION

In accordance with the present invention, a resilient support for a bearing block or similar fitting is provided, said support comprising a member in the form of a conical section and being composed of a resilient or flexible polymeric material. The member is disposed between the base of the block and the fitting on the deck to resiliently hold the block in an upright position. The resilient cone surrounds the connecting portions between the block and the deck to prevent entanglement of lines.

The conical support is light in weight and yet provides the necessary resilient lateral support even for heavier blocks. The conical member may also be designed such that it can be inverted to allow access to the bolts or attachment members on the deck during installation or removal.

THE DRAWINGS

DESCRIPTION OF THE PREFERRED EMBODIMENTS

Figures 1, 2, 3:
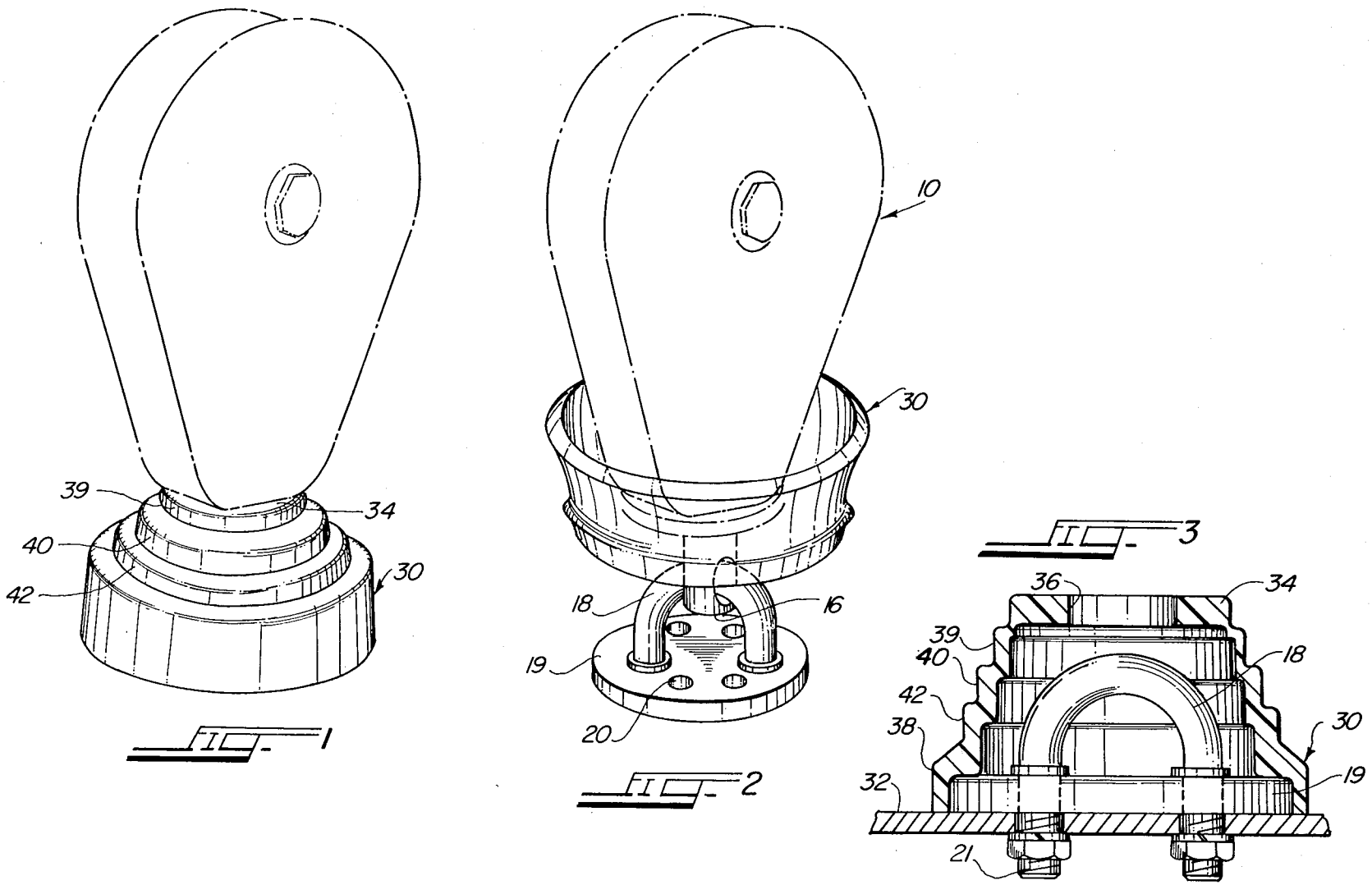
FIG. 1 is a perspective view of a bearing block with the resilient support of the present invention being shown in operative position.
FIG. 2 is a perspective view similar to FIG. 1 in which the resilient member is an inverted position.
FIG. 3 is a vertical sectional view of the resilient support together with the attachment base.

As shown in FIGS. 1 and 2, a conventional pulley, bearing block, or similar fitting 10 is shown in outline and may comprise a grooved sheave mounted for rotation between side plates in the usual fashion. An attachment post 16 extends from the base of the block to enable attachment of the block 10 to the deck or other support surfaces. The sheave of the block receives a line of the running rigging of the boat, in accordance with conventional practices.

In the embodiment shown, the turning post 16 may have an aperture, into which is disposed a U-shaped eye 18, with the legs thereof being secured to an attachment base 19 having apertures 20 to receive securement bolts 21 (FIG. 3). Whereas various forms of attachment may be used, it may be seen that the pivotal attachment between the block and support base would allow the block to flop from side to side in the absence of a resilient support.

In accordance with the present invention, a resilient support member, generally indicated at 30, is provided between the base of the block 10 and the support surface 32 (FIG. 3), such as the deck, rail, or other surface against which a block may be attached. The support 30 is generally in the form of a right conical section, with the portion adjacent the base of the block being smaller in diameter than the portion at the attachment base. The support 30 thus retains the block in an upright position. The support is a unitary member and is preferably composed of a tough, flexible and impervious polymer, such as polyurethane or a material having similar properties.

As shown, the support 30 comprises an upper annular wall 34 disposed against the base of the block, said wall being provided with a central opening 36 to receive the turning post 16. The lower portion may comprise a cylindrical section 38 adapted to fit around the annular base 19 of the padeye.

Several details of construction are noteworthy and provide important benefits. In general, the conical form provides a progressively increasing spring rate and hense increased resistance as the block continues to tilt toward one side. Thus, the block has good freedom of movement near the upright position but is constrained against hitting the deck. It will be understood that the spring rate could be easily altered by increasing the wall thickness at certain areas, such as at the base.

Another important feature is the stepped or so-called "wedding cake" construction as shown. Preferably, the member 30 comprises a plurality of coaxial cylindrical sections such as 39, 40, 42, etc. When viewed in cross section, as shown in FIG. 3, the coaxial sections are of decreasing diameter from the base and are telescoped to provide shoulders in the overlapping areas.

The importance of the stepped construction is indicated in FIGS. 1, 2 and 3. When the support 30 is in its normal configuration, it would be difficult to gain access to the mounting bolts 20 in the padeye during installation or removal. The stepped construction allows the member to be more easily inverted or turned inside out to the configuration shown in FIG. 2, allowing access to the attachment base. Without the stepped construction, the support, due to its resiliency, would tend to return to its normal configuration and would complicate attachment and removal of the fitting.

In summary, the device of the present invention provides a convenient and fail-safe upright support for a pivotally mounted yacht fitting and also provides a protective boot around the attachment members.

What is claimed is:

1. A resilient support for a yacht fitting wherein a pivotal connection is provided between the fitting and a support surface, said resilient support comprising a hollow conical member of resilient material extending between said fitting and said support surface and around said pivotal connection to cover said connection, the portion of said conical member adjacent said fitting being smaller diameter than the portion adjacent said support surface and providing lateral resilient support against tilting of said fitting to one side.

2. The resilient support of claim 1 wherein said yacht fitting is a bearing block having a base, and a turning post extends from said base.

3. The resilient support of claim 2 wherein the conical member has an opening in the smaller diameter portion, and said turning post is received through said opening.

4. The resilient support of claim 3 wherein said smaller diameter portion comprises a wall and said opening is in said wall.

5. The resilient support of claim 1 wherein said conical member is invertible to a set position to uncover and allow access to said pivotal connection.

6. The resilient support of claim 1 wherein said conical member is molded from a polymeric material.

7. The resilient support of claim 1 wherein said conical member comprises a plurality of coaxial cylindrical sections of progressively decreasing diameter.

* * * * *